US005799939A

United States Patent [19]

Schneider

[11] Patent Number: 5,799,939

[45] Date of Patent: Sep. 1, 1998

[54] ANAMORPHOSES FOR GAMES, EDUCATION AND PROMOTIONS

[75] Inventor: Wesley C. Schneider, Chicago, Ill.

[73] Assignee: Wesleyan Company, Inc., Kenilworth, Ill.

[21] Appl. No.: 572,688

[22] Filed: Dec. 14, 1995

[51] Int. Cl.[6] ..... A63F 3/06

[52] U.S. Cl. ..... 273/138.1; 273/249; 273/237; 273/288; 273/293; 472/63; 40/582; 40/900; 283/901

[58] Field of Search ..... 273/288, 287, 273/269, 302, 293, 236, 237, 243, 249, 429–432, 441, 139, 138.1; 472/63; 40/900, 582; 283/901

[56] References Cited

U.S. PATENT DOCUMENTS

| | | | |
|---|---|---|---|
| 2,697,380 | 12/1954 | Wyser | 40/900 |
| 3,785,819 | 1/1974 | Barnes, Jr. et al. | 350/420 |
| 3,834,051 | 9/1974 | Barnes, Jr. et al. | 40/582 |
| 5,224,901 | 7/1993 | Dahl et al. | 472/63 |
| 5,314,197 | 5/1994 | Hersch | 273/430 |

OTHER PUBLICATIONS

Jeunesse, Allimard "Secrets Des Anamorphoses", ©1995, pp. 1–32, plus advertising page.

Bolton, Linda "A Cache–Cache avec l'Art", ©1984, pp. 1–57.

Sturges, Alexander "Magic In Art", ©1994, pp. 20, 21, 32.

Leeman, Fred, "Hidden Images, Games of Perception, Anamorphic Art, Illusion, from the Renaissance to the Present", 1975, Harry N. Abrams, Inc., Publishers, New York.

"Secrets Des Anamorphoses," Gallimard Ieunesse, 1995, pp. 21, 24, 24a and 25.

"A cache–cache avec l'Art," La Joie par les Livres, 1994, pp. 50, 51 and 56.

*Primary Examiner*—Benjamin H. Layno

*Attorney, Agent, or Firm*—Rockey, Milnamow & Katz, Ltd.

[57] ABSTRACT

A device for decoding distorted images from a sheet which includes a reflecting geometric figure to be placed on the sheet and can include portions of the decoded image being permanently applied to the reflecting surface for combination with decoded distortion images from the sheet to form a complete image. A reflecting surface can be applied onto a beverage can to decode an anamorphic image applied onto a separate sheet. A reflecting canister can be used to decode distorted images and include a removable top to hold images therein and a light source to illuminate distorted images for reflection. A game is described which uses geometric reflecting pieces to decode commands of the game. A teaching game described having a question sheet with a distorted image representing the answer to the question which can be decoded by use of a geometric reflecting device.

61 Claims, 8 Drawing Sheets

FIG.6
(PRIOR ART)
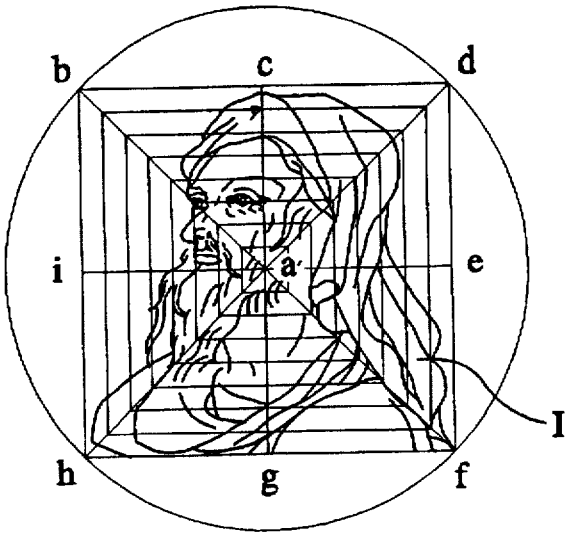
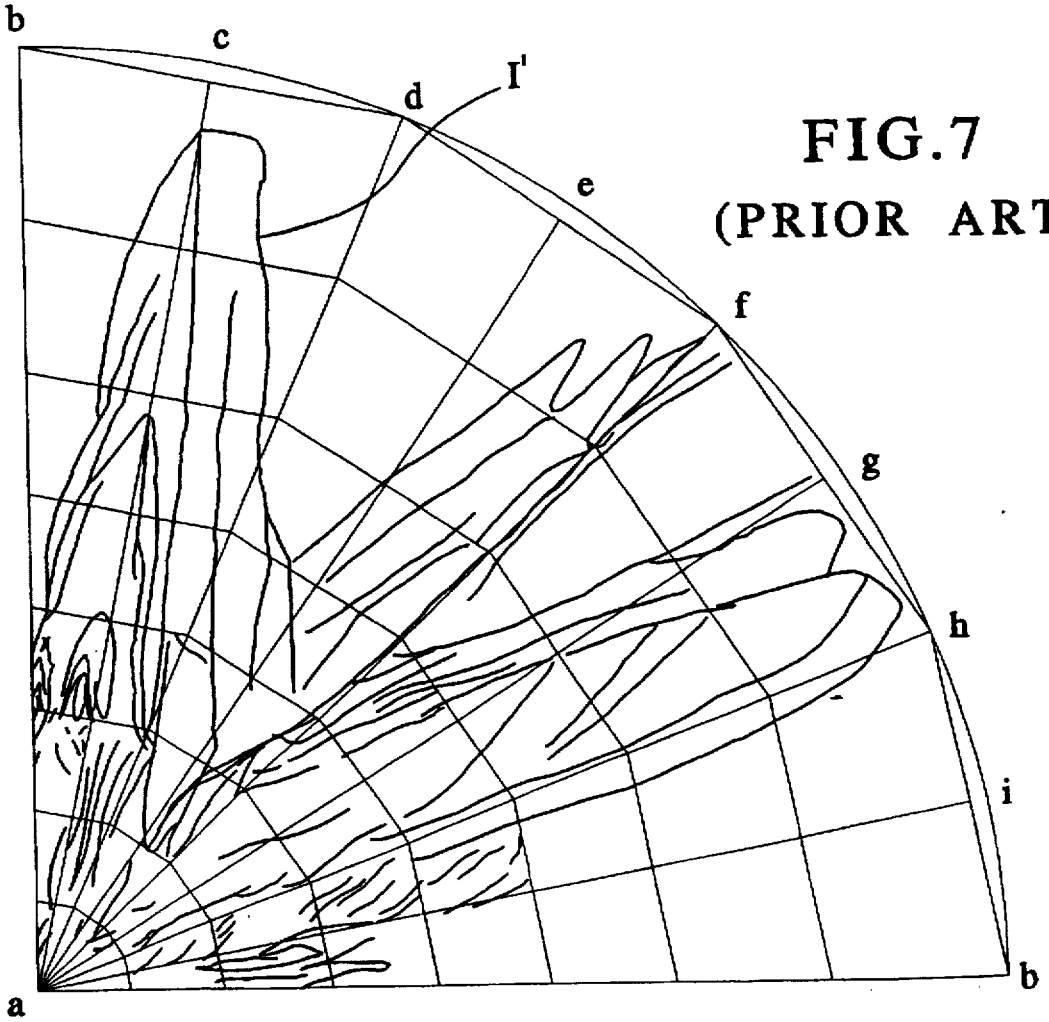
FIG.7
(PRIOR ART)

ANAMORPHOSES FOR GAMES, EDUCATION AND PROMOTIONS

BACKGROUND OF THE INVENTION

1. Field of the Invention

The present invention relates to anamorphic art and in particular to the application of anamorphic art to games, amusements, and teaching devices.

The word "anamorphoses" is derived from the Greek "ana" (again) and "morphe" (shape). The word describes a purposely distorted image wherein a person viewing the distorted image must re-form or reshape the image into a centralized or reorganized perspective in order to rationalize the relationship between that object and the viewer. By purposely distorting an original image, a viewer using a geometric reflecting device, or an image of such reflecting device on a computer screen, or by otherwise reshaping the image, can reshape that image into its original form for visual understanding by the observer. The process of "properly" distorting the original image so that it may be reshaped by the geometric reflecting device, to "decode" the original distorted image can be accomplished experimentally, geometrically and by computer imaging. The image can be produced in a pyramidal, rectangular, conical or cylindrical anamorphoses and then can be reshaped.

2. Description of the Related Art

The concept of anamorphic sketching dates back to Leonardo DeVinci and his Codex c. 1485. Curved perspective, curved and discontinuous planes, perspective cabinets, perspective anamorphoses and their reflecting cones and cylinders were known in the 18th century. In the 19th century, these techniques were adapted to children's rooms and as exercises for artist in art schools. Some current computer programs also alter perspective, such as CAD-CAM software programs and art software, e.g., CORREL DRAW and SCIQUEST programs in the production of art for commercial usage.

Constructing perspective anamorphosis is a geometrical exercise and is analogous to traditional perspective construction. As an example, "cone anamorphoses" are created via geometric methods by inverting and expanding the original art via diagonals that make 45° angles with the picture plane and run into the so called distance point. Through the projection of a grid, like that of a checkerboard, in anamorphic perspective it is possible to transfer the image of any subject.

FIGS. 1 and 2 demonstrate a known arrangement for producing a cylindrical anamorphosis using a cylindrical reflecting device. This image construction is attributed to Jean-Francois Niceron, *La Perspective Curieus*, Paris, 1638 reproduced from *Hidden Images, Games of Perception, Anamorphic Art, Illusion*, Harry N. Abrams, Inc. Publishing, New York 1975. The image shown in the grid in FIG. 1 is cylindrically distorted according to the plot of FIG. 2. The square grids marked across columns a–l and down rows m–z shown in FIG. 1 are made arcuate and increasingly elongate outwardly according to FIG. 2, and like corresponding squares are marked according to rows m–z and columns a–l in FIG. 2. Placing a reflecting right circular cylinder upstanding from the circle C will result in an upstanding reflected image on the surface of the cylinder identical to that shown in FIG. 1. The selected image l shown in FIG. 1 is purposely distorted into the image l' of FIG. 2 with each grid shown in FIG. 1 holding a corrected portion of the image l as a corrected portion of the corresponding grid of distorted image l'. Thus, a distorted image can be created grid element by grid element to create the anamorphically corrected image.

FIGS. 3 and 4 demonstrate a further anamorphic image using a cone reflecting device. The image shown in FIG. 3 can be purposely distorted as shown in FIG. 4. The sectors extending circumferentially around the image marked a–h proceeding radially from a center point i are inverted radially in the distorted image of FIG. 4. For example, between sectors a and h, the grid elements m, n, o, p shown in FIG. 3 are created by the corresponding distorted grid elements m', n', o', p' in FIG. 4. When a cone is placed in the central circle C, the distorted image is reversed and an image such as shown in FIG. 3 is observed from an observation point directly above the cone looking down on an apex of the cone corresponding to the center point i. The locator makes a–h in FIG. 3 correspond to the marks a'–h' in FIG. 4. This example was taken from Jean DuBreuil, *La Perspective Pratique*, Paris, 1649, reproduced from Hidden Images, supra.

FIG. 5 demonstrates a further anamorphic exercise wherein a multi-image distorted flat sheets having four distorted images $1_1$, $1_2$, $1_3$, $1_4$ can be anamorphically converted to a single corrected image $1_5$ by placing a square base pyramid P at a predisposed position in the center of the sheet S. As demonstrated in FIG. 5, the distorted images $1_1$, $1_2$, $1_3$, $1_4$ are corrected and combine to create the single corrected image $1_5$ by viewing the rectangular pyramid downwardly upon its apex A. The images $1_1$, $1_2$, $1_3$, $1_4$ are reflected on the sides 10, 12, 14, 16 of the pyramid. This example was taken from Henry Kettle, *Pyramid Anamorphosis: Four Male Portraits Become One*, 1770, reproduced from *Hidden Images*, supra.

FIGS. 6 and 7 demonstrate a further anamorphic technique wherein the viewer's perspective can render an otherwise imperceptible image into a perceptible image. FIG. 7 demonstrates a flattened pyramidal anamorphosis wherein if the image shown in FIG. 7 is constructed into a pyramid having an apex a and a base delimited by the line segments b–d, d–f, f–h, and h–b, an observer looking downward upon the apex a perpendicular to a square base delimited b, d, f, h views the distorted image l' as the corrected image l. This anamorphoses is a development of a geometric anamorphoses wherein the plane of observation of each panel of the pyramid is observed from an oblique angular orientation by the observer, the four panels creating together a single image. This example was taken from Jean-Francois Niceron, *Pyramidal Anamorphosis, Thaumaturgus Opticus*, Rome 1646, reproduced in *Hidden Images*, supra.

SUMMARY OF THE INVENTION

It is an object of the present invention to provide a game, amusement device, teaching aid or marketing device embodying a procedure which provides a distorted image which can be corrected to a perceptible or matching image to achieve a function of the procedure.

It is an object of the present invention to provide a method for playing a game, amusement device, or teaching aid which provides a distorted image, not readily recognizable, and which as a result of playing the game, operating an amusement device or completing a teaching exercise can be decoded or reorganized to create a perceptible image.

It is an object of the present invention to provide a challenging visual art game, amusement device or teaching aid.

It is an object of the invention to provide an improved reflecting device for decoding an anamorphic image which provides for decoding the image in the dark. It is an object of the invention to provide an improved reflecting device which provides convenient storage of the image within the reflecting device.

The objects of the invention are achieved in that a game, amusement device or teaching aid is provided wherein an image, either a complete image or a partial image, is distorted anamorphically and in undertaking the method of the game, amusement device or teaching aid, the image is completed, and reoriented and decoded to create a sensible image to the viewer, or the image is complete but distorted an din undertaking the method the image is decoded. The image can be distorted to be decoded by a cylindrical reflecting device, conical reflecting device, pyramidal reflecting device, or other device, or can be reoriented by reorienting the image itself such as by folding the image into a pyramid or cone and observing the reoriented image from a preselected perspective.

The object is achieved in that games are produced for playing by people for entertainment purposes, by governments for lotteries, by corporations for promotional campaigns, by collector card companies to sell sets of adventure, sports or other playing cards, by organizations for teaching, educating and reinforcing concepts, e.g., multidimensional flashcards for learning math, geography, languages, alphabets, art, history, etc., and for advertising and sales promotion agencies for legal games of chance.

The object is achieved in that a commodity holding package such as a beverage can, such as a soft drink or beer can, which is capable of having a reflecting surface such as an aluminum surface, and can serve the dual function of being a beverage can and being a cylindrical reflecting device to decode a cylindrical anamorphosis. A partial image or code can be preprinted on the can which when the can is placed in a proper orientation on a distorted image decodes the distorted image to be reflected onto the can to mesh with the preprinted image on the can to produce a perceptible image. As applied to a game or amusement device, players who obtain two matching playing pieces (such as the can and a distorted image on a sheet) wins if the correct perceptible image is created. The game can require a plurality of correct sheet matching cans on a single sheet, or a plurality of can and sheet combinations to complete a message.

As an added feature of the game to generate interest or to reduce the odds of winning, a scratch-off emulsion can be applied over a distorted image requiring a player to preselect an image from a number of images and match the CRD can onto that image to determine whether a perceptible image is created.

Advantageously, the distorted image can be applied to a box, the box holding inside the reflecting device for decoding the distorted image. This is advantageously applied in the case of a cereal box holding both cereal and the reflecting device within.

Distorted images can be produced in a series of teaching books wherein students use reflecting devices to reveal corrected images or messages. The distorted messages can be the correct answer to an academic question or for generating interest in art, optics, or perspective.

Additionally, an action game can be produced in a board game format wherein distorted images are applied to the board game and players can use reflecting devices to decode messages or characters for which a correct decoding of a distorted image influences the game. A correct reflecting device must be matched onto the image to obtain the results of that image. A replaceable surface or individual surfaces, can be applied to the game to create new distorted images for new permutations of the game.

The object of the invention is achieved in that a cylindrical reflecting device ("CRD") is provided having a removable end cap for allowing insertion of distorted images in card form or in rolled scroll form into the reflecting device as a convenient way to ship, store and sell distorted images within its respective reflecting device.

A reflecting device such as a CRD can also feature an inventive light ring arranged around a base of the reflecting device powered by batteries to allow playing of games in the dark. This is particularly desirable for mystery games for enhanced atmosphere. Alternately, the light ring can be provided near a top of the CRD to direct the light downwardly. The light can be incorporated into the removable cover of the CRD. A light can also be incorporated into other shaped reflecting devices, e.g., cones, pyramids, etc.

As an analogous procedure to the mechanical decoding of anamorphic art described above, computer graphics can be utilized to produce interactive software games which lets players choose from a "deck", a series of game pieces in many shapes and colors. The object is to be the first to decipher the complete image using a computer generated reflecting device that is won or earned by achieving the required level of points. The winner of the game correctly solves the image puzzle. A computerized graphic can also be created as a challenge for players by picking a series of shapes to fill in those puzzles with the pieces to create an on-screen anamorphosis or distorted image and then use his on-screen reflecting device to read the distorted message to lead him to another play level or reveal if he has won the game. A software system can be provided to develop anamorphoses producing exact specifications for the development of a precisely sized reflecting device.

BRIEF DESCRIPTION OF THE DRAWINGS

FIG. 6 is a prior art plan grid view of an image applied onto a rectangular pyramid when viewed toward the apex perpendicular to a base of the rectangular pyramid;

FIG. 7 is a prior art distorted image of a flattened rectangle according to FIG. 6 when viewed perpendicularly to the flattened sides of the pyramid;

DETAILED DESCRIPTION OF THE PREFERRED EMBODIMENTS

Figure 8:
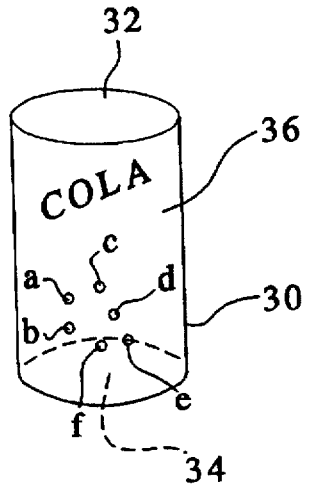
FIG. 8 is a perspective view of a can of the present invention.

FIG. 8 illustrates a package for a commodity such as a beverage can 30 containing cola, or alternatively beer, or any food or non-food item. The can provides a top 32, a bottom 34 and a cylindrical wall 36. The cylindrical wall 36 is fashioned with a reflecting surface such as a high gloss aluminum, or a plated mirror surface to reflect an image thereon. Imprinted or embossed on the surface 36 is a portion of an image, such as a dot code represented by the dots a–f. The image can be a recognizable image, or can be a partial image to the extent that it is not recognizable as an image.

Figure 9:
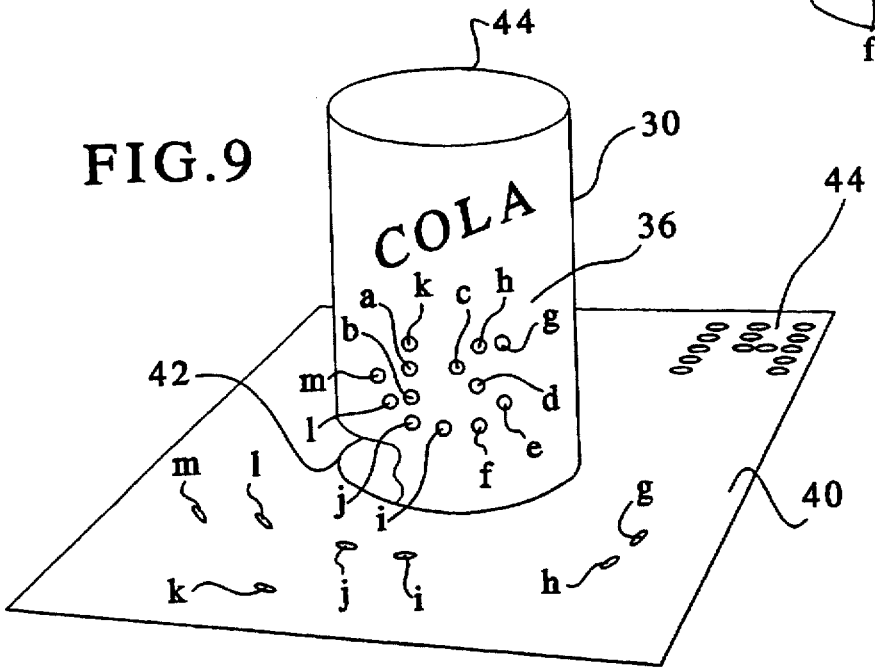
FIG. 9 is a perspective view of the can of FIG. 8 applied onto a distorted image.

FIG. 9 discloses the can 30 set upon a game sheet or a game card 40 which can be a piece of paper, a coaster, a page of a newspaper or magazine, or any flat surface which can hold visual information. The flat surface includes a centrally located circle shown partially beneath a broke away section of the can 30. The circle 42 corresponds to the circumference 44 of the can 30 so that the can can be placed in proper position on the card 40. On the card are located a series of marks such as dots g, h, i, j, k, l, and m. Theses dots are arranged to reflect onto the surface 36 of the can 30. Thus, an image is formed on the surface 36 of the can 30 which includes both the pre-applied dots a–f and the dots from the card h–m. In FIG. 9, these combined groupings of dots create an image which is non-descript, i.e., scrambled. The card 40 in FIG. 9 contains a corrected image 44, or image intended to be matched which is in this case is the number "14". In a hypothetical game, if the complete image reflected onto the cola can matched the number 14, a winning combination has been achieved.

Figure 10:
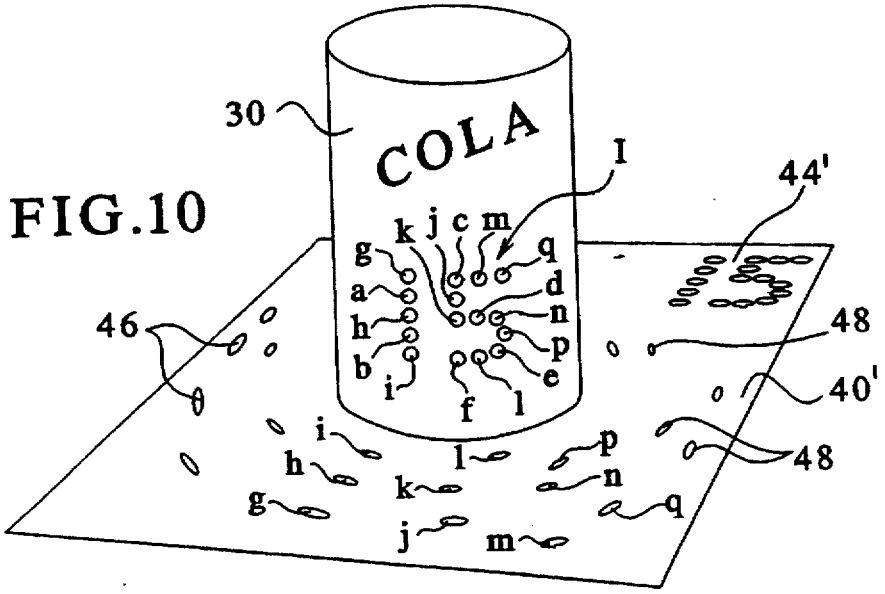
FIG. 10 is a perspective view of the can of FIG. 8 applied onto a second distorted image.

FIG. 10 illustrates a winning combination wherein the preprinted dots a–f in combination with the reflected dots h–n produce the number "15" which matches the image 44' of the number "15" on the game card 40'. Additional random dots such as 46, 48 and others shown, can be placed on the card at orientations such that these dots do not interfere with the image 1 created on the can 30. Therefore, with the plurality of dots on the card, and depending on the rules and directions to the game, proper orientation must also be discovered to obtain the image 1.

For purposes of description and clarity a simplistic image such as the number "14" or the number "15" formed by dots has been described. However, more sophisticated and densely arranged dot patterns or graphical images can be used for either pictorials, graphics, or numbers which combine preprinted information on the can with reflected information on a substrate sheet. A dot matrix type portrait of a sports celebrity can be either partially printed on the can and completed by a decoded anamorphic image or be a complete decoded anamorphic image. Additionally, a wining combination can include a plurality of correctly matched cans with a plurality of sheets, or images upon a single sheet, or images at varying rotational position of the can on the single sheet as shown for example in FIG. 10.

It is therefore an advantage of the invention that a customer would need to purchase a number of cans of the commodity, such as cola, the cans having preselected and different patterns of dots, pictorial information, graphics or other information which is combined with the information on the card. The cards can be packaged with the commodity or provided separately at participating stores. Alternately, the beverage can can be a plain reflective surface and the complete distorted image can be contained on the game card 40'. In such case, either a single winning game card would be required or a series required to qualify as a winner.

Figure 11:
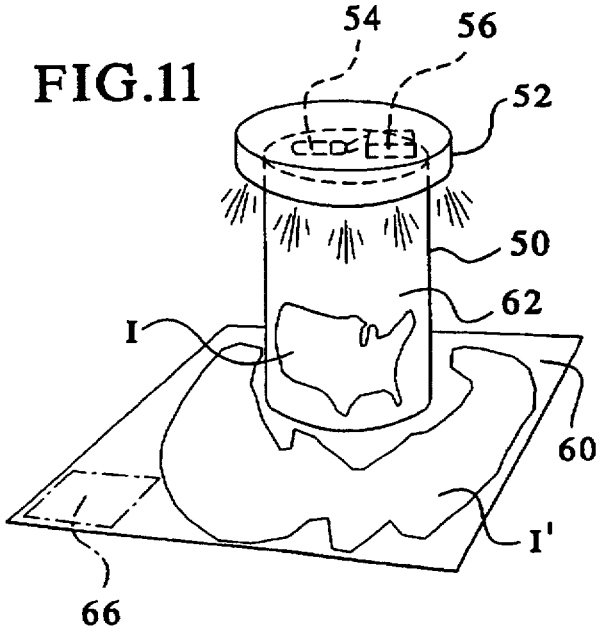
FIG. 11 is a perspective view of a cylindrical reflecting device applied onto a distorted image.

FIG. 11 illustrates additional aspects of the invention in an embodiment applied as an academic tool. A cylindrical reflecting canister 50 is provided with a cover 52 having a light element 54 powered by a battery 56. The cover 52 overhangs the cylinder 50 such that light can proceed downward from the cover 52 around the canister 50. This light element provides a convenience means for viewing distorted images in the dark for more dramatic visual effect. A question sheet 60 is provided with a distorted image l' which, when reflected onto the cylindrical reflecting surface 62 of the canister 50 provides a corrected image 1 on the cylinder surface 62. A question box 66 can be provided with an academic question such as "George Washington was the first president of what country?" After responding to the question, the student can reveal the answer displayed as a corrected distorted image on the surface 62.

Figure 12:
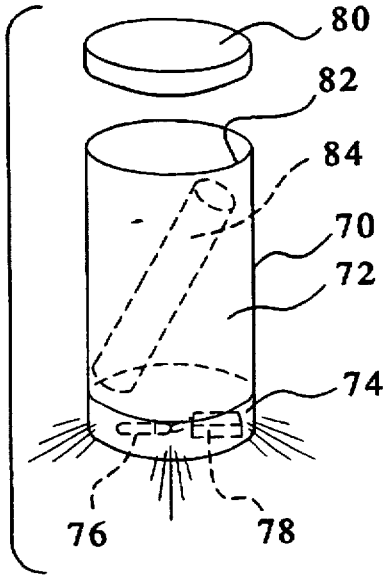
FIG. 12 is an exploded perspective view of a further reflecting device according to the present invention.

FIG. 12 illustrates a practical embodiment of the invention wherein a canister 70 having a reflecting surface 72 is provided with a translucent panel 74 covering a light 76 powered by a battery 78 at a bottom of the canister. As in FIG. 10, for example, the canister is place upon a card or sheet to decipher a distorted image. The canister can be provided with a removable top 80 which closes an open end 82 of the canister for storing rolled distorted images 84 or cards within the canister 70. These rolled distorted images can be academic questions such as described in FIG. 11 or can be baseball cards, action hero cards, or other entertaining or educational pictorials.

Figure 13:
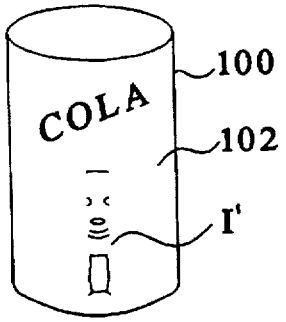
FIG. 13 is a perspective view of a second can according to the present invention.
Figure 14:
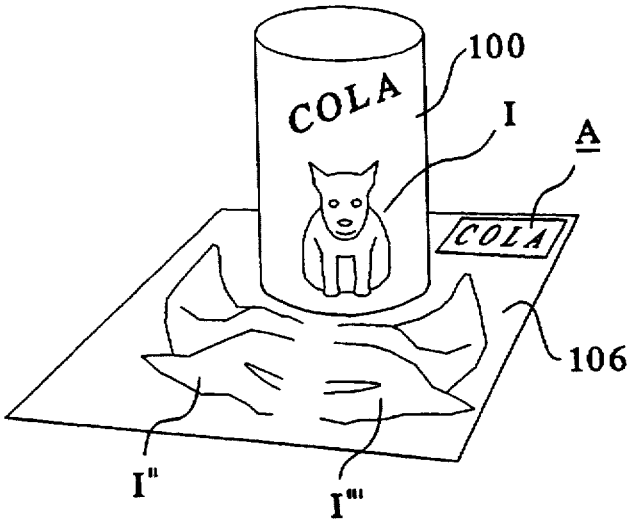
FIG. 14 is a perspective view of the can of FIG. 13 applied onto a distorted image.

FIG. 13 shows an alternate can 1 00 to the can shown and described in FIGS. 8–10. The can 100 is provided with a reflecting surface 102 and a partial image l' permanently applied to the can. As shown in FIG. 14, a substrate 106 is configured to receive the can 100 within a predetermined location circle (not shown) which in FIG. 14 is covered by the can. When placed in the proper location and orientation, anamorphic images l" and l'" combine with the image l' to form the completed and decoded image 1 onto the can 100. As illustrated the image 1 being a dog, viewable in FIG. 14 but not viewable in FIG. 13. The substrate 106 can, for example, be a coaster or placemat in a drinking or eating establishment and which can contain advertising for the maker of the commodity held by the can 100 for promotional purposes. Additionally, as previously described in FIGS. 8–11, the configured image 1 can serve game or amusement purposes or be educational.

Figure 2:
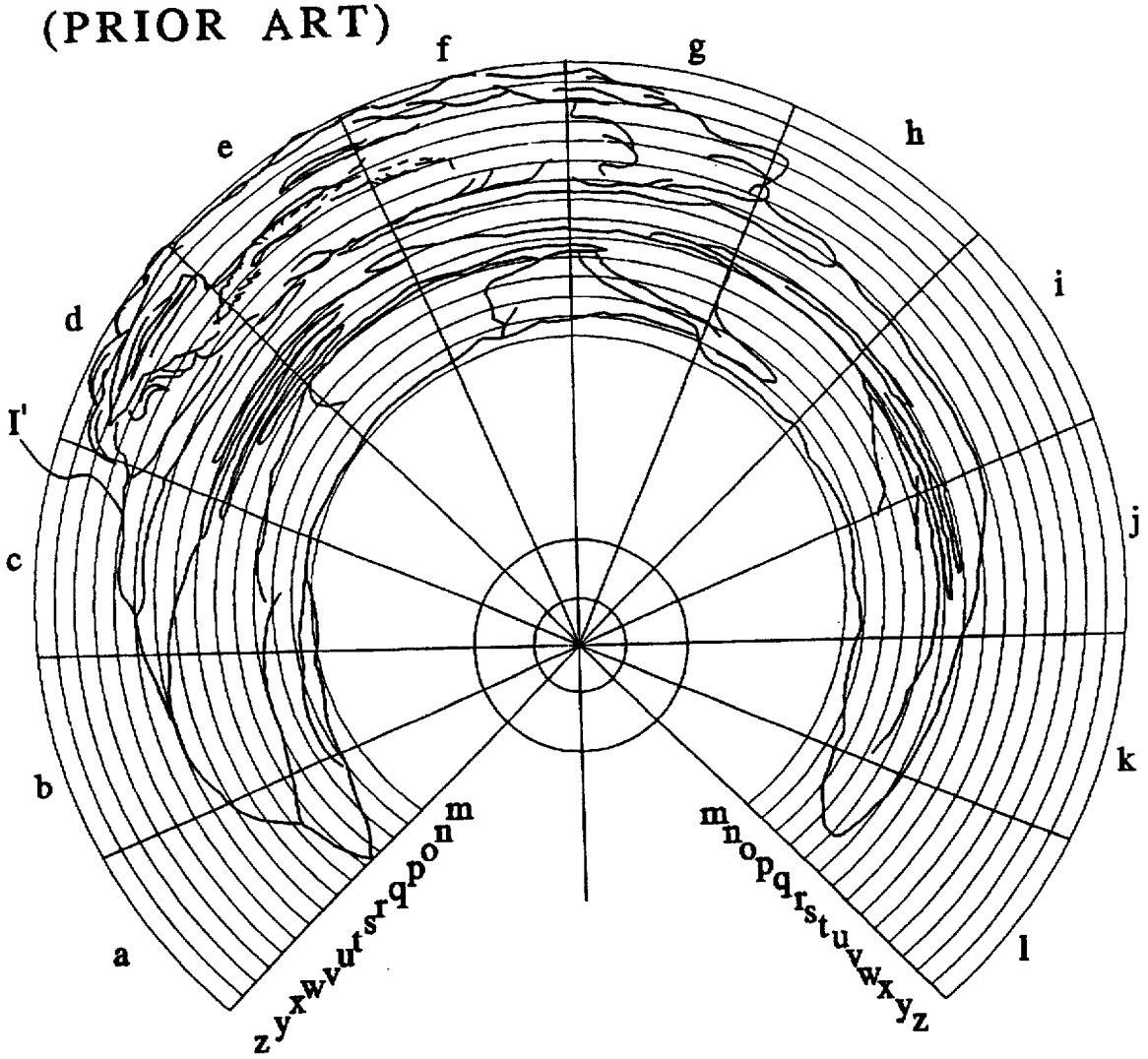
FIG.2 (PRIOR ART)
FIG. 2 is a prior art plan distorted grid view of the image of FIG. 1.
Figure 1:
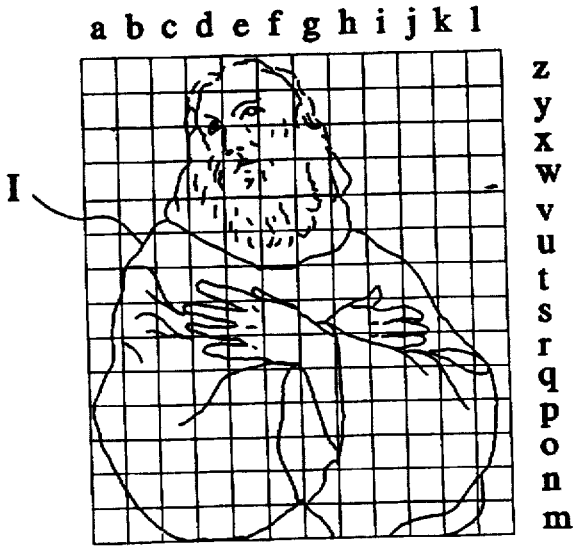
FIG.1 (PRIOR ART)
FIG. 1 is a prior art plan grid view of an image.
Figure 3:
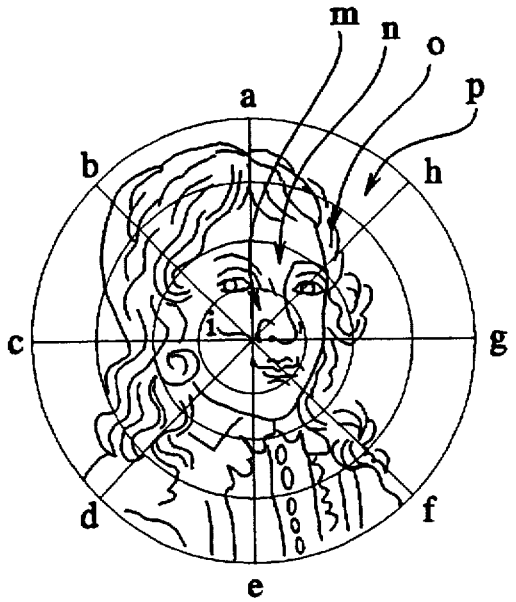
FIG.3 (PRIOR ART)
FIG. 3 is a prior art plan view of an image reproduced by a reflecting cone.
Figure 4:
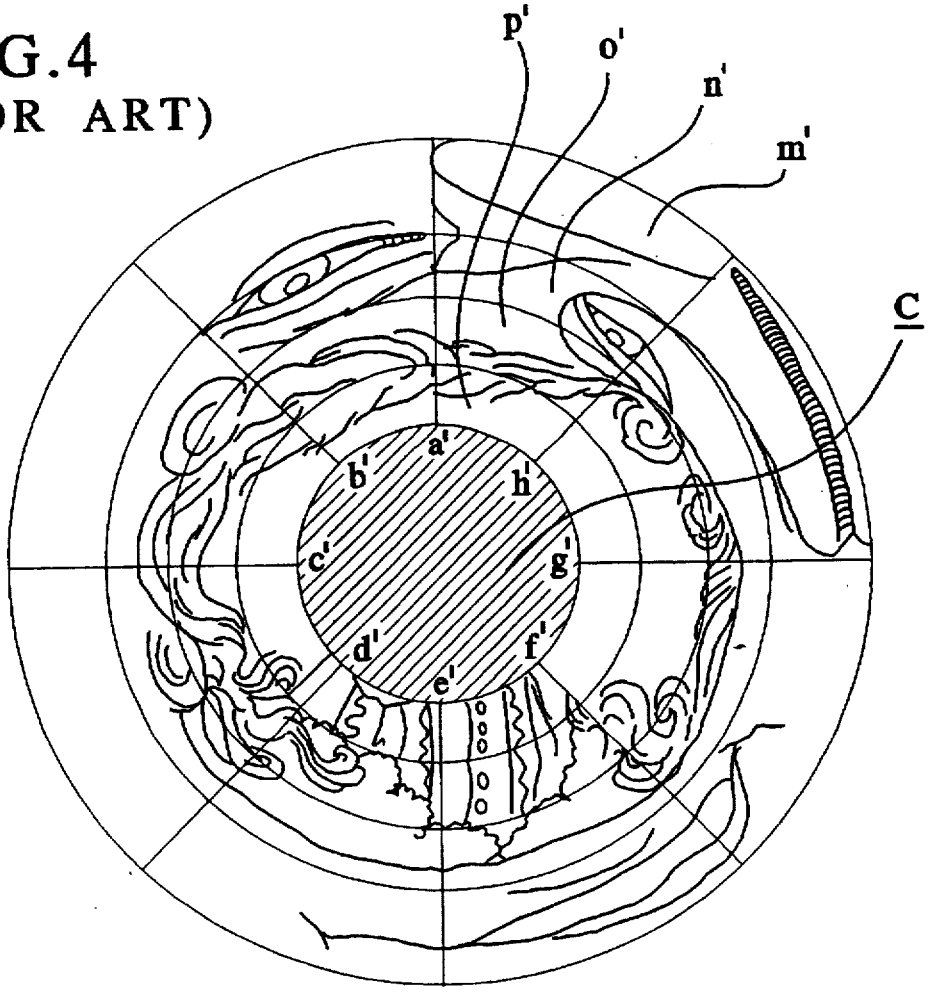
FIG.4 (PRIOR ART)
FIG. 4 is a prior art plan view of a distorted image decoded by the cone of FIG. 3.
Figure 5:
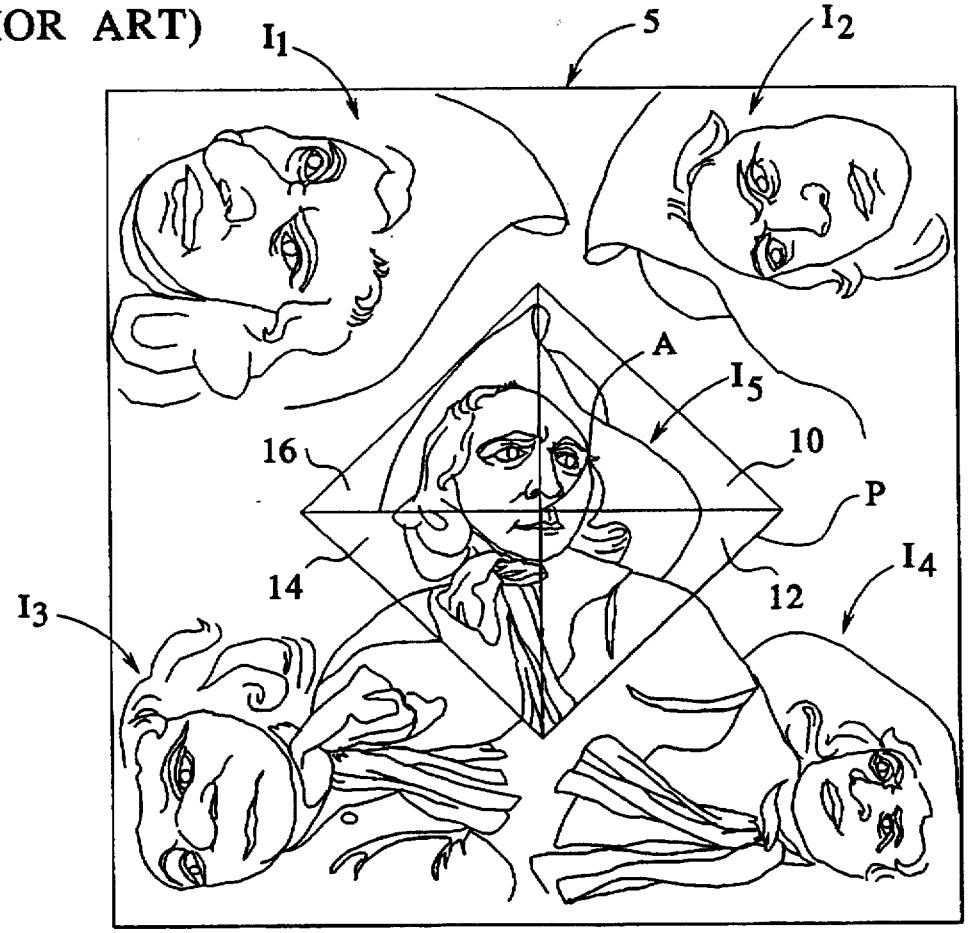
FIG.5 (PRIOR ART)
FIG. 5 is a prior art plan view of a distorted image decoded by a reflecting pyramid.
Figure 15:
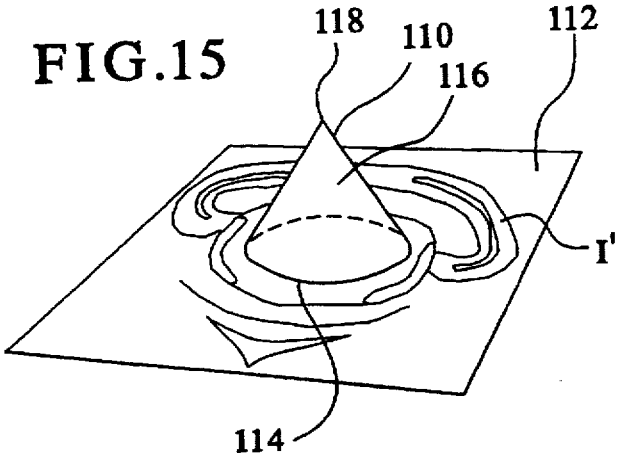
FIG. 15 is a perspective view of a cone reflecting device applied onto a distorted image.
Figure 16:
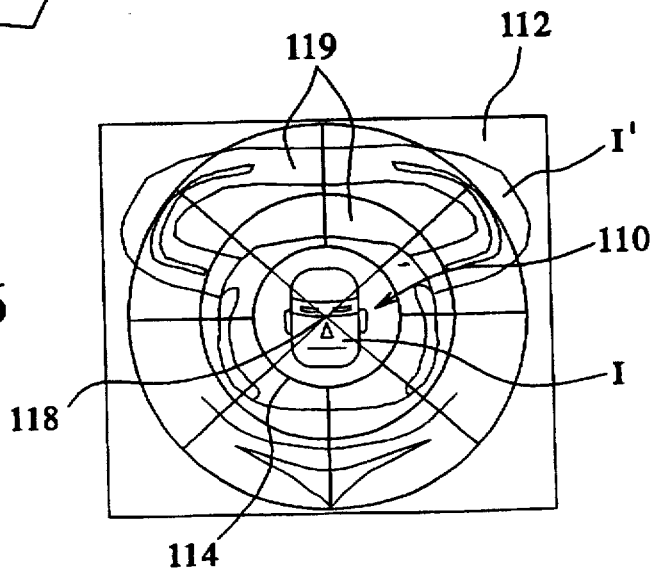
FIG. 16 is a plan view of the arrangement of FIG. 15.

FIGS. 15 and 16 illustrate a further anamorphic design where instead of a cylinder reflecting device, a conical reflecting device is illustrated. The cone 110 is set upon a substrate 112 having a distorted image l' which surrounds a central circle on the card 112 (not shown) covered by a circular base 114 of the cone 110, to precisely locate the cone 110 on the substrate 112. The image l' surrounds the cone and is reflected onto a reflecting conical surface 116 extending upwardly into an apex 118 of the cone. When viewed from directly above the cone looking down on the apex 118, an image 1, for example a simplistically drawn "cartoon superhero," can be seen. The more precise description of creating the conical anamorphic art is described for example in FIGS. 3 and 4 above. As with FIGS. 8–14, the cone 110 can be used in games, amusements, and educational devices, and can include portions preprinted on the surface 116 of the cone 110 which are combined with distorted portions on the card 112, to form a complete and unscrambled image.

Figure 19:
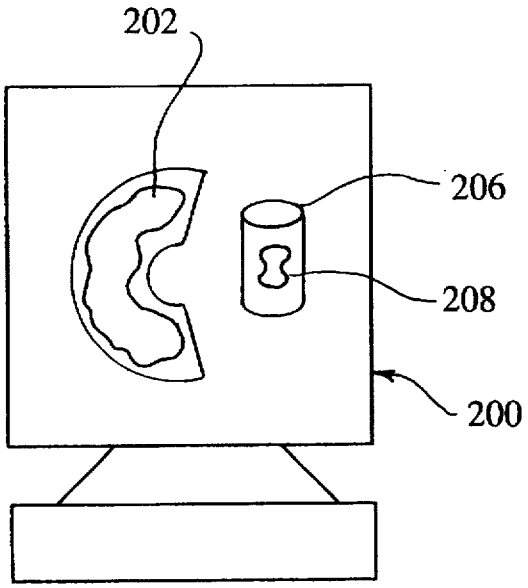
FIG. 19 is a schematic diagram of a further alternate embodiment of the present invention.

The embodiment of 15 and 16 is particularly advantageous to playing an inventive puzzle game. Arcuate removable grid pieces 119 having images printed thereon are arranged concentrically around the reflective device 110 accordingly to create the distorted image I' on the substrate 112. The game can thus operate on two levels, the proper pieces must be selected from a supply of pieces placed correctly with respect to each other, and a correct anamorphic reflecting device must be selected to properly reflect the constructed distorted image into a perceivable corrected image I, reflected on the reflective device. The puzzle pieces can be selected from a "deck" of pieces including surplus nonmatching pieces. The pieces can be "earned" or "bought" by points or other selection processes. The player can then choose when to select an anamorphic device, cone, pyramid, cylinder, etc. to decode the complete or nearly complete puzzle. The game and its permutations can be a board game or computer graphic game analogous to the board game. The pieces 119 can be selected by keyboard or mouse commands and the anamorphic reflecting device can also be computer generated and selected by keyboard or mouse command. FIG. 19 schematically illustrates a computer screen 200 showing a computer-generated anamorphically distorted image 202 and a computer generated reflecting device 206 displaying a computer generated decoded image 208 thereon.

Figure 17:
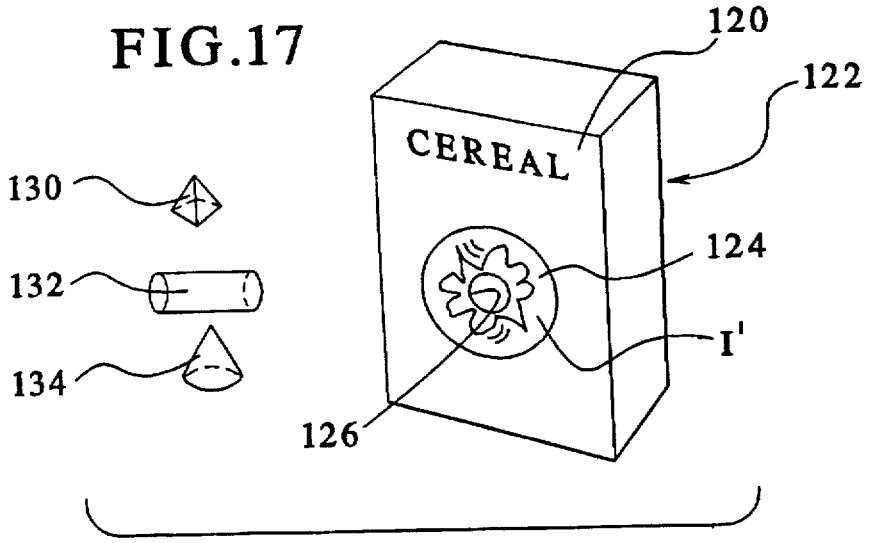
FIG. 17 is an exploded perspective view of a further application of the present invention.

FIG. 17 illustrates an advantageous adaptation of the present invention wherein a back panel 120 of a cereal box 122 has imprinted thereon a distorted image I' within an annular field 124 and includes a location circle 126. Within the box for sale would be included a reflecting device such as a pyramid 130, a reflecting cylinder 132, or a reflecting cone 134. When one of these devices is placed within the circle 126, the reflection of the distorted image I' displays a decoded message or character or pictorial or graphic on the reflecting device 130, 132, 134. The reflecting device would be matched to the image I'. Alternately, the reflector can be sold separately and the anamorphic images can be randomly chosen between the three named types or other shaped reflecting device.

Figure 18:
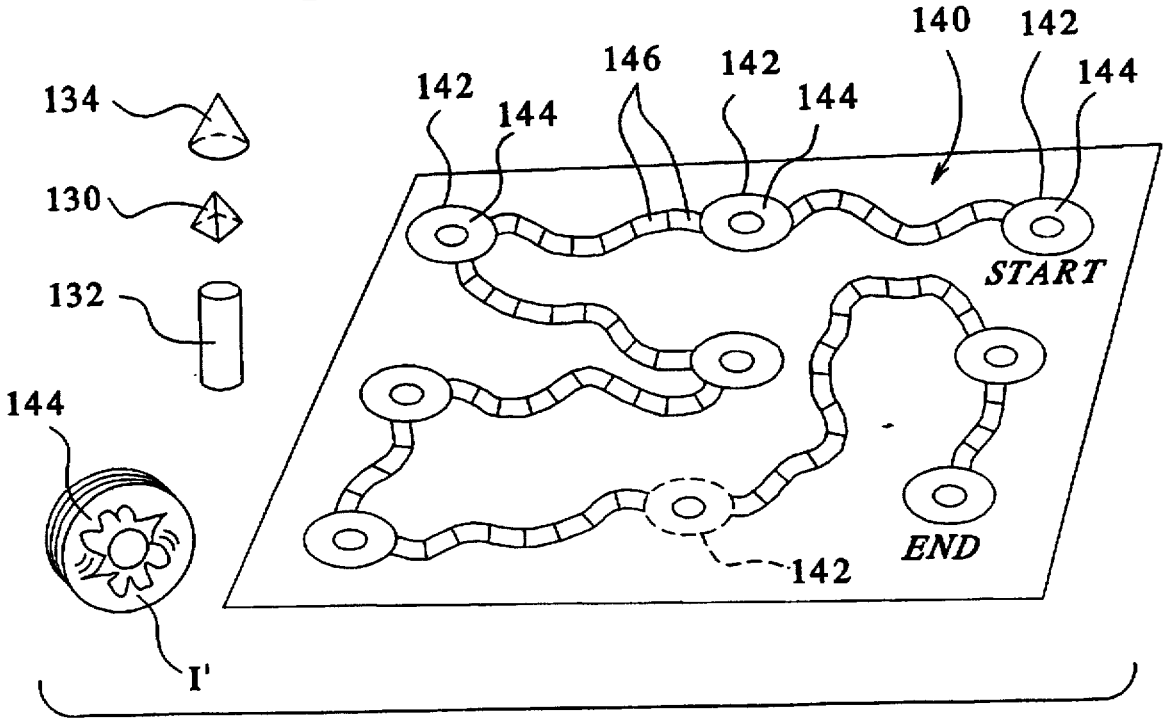
FIG. 18 is an exploded perspective view of a still further application of the present invention.

FIG. 18 discloses a board game using a playing field 140 having a plurality of staging areas 142 which receive on them appropriately sized anamorphic image disks 144 each having a scramble anamorphic image thereon of a particular type such as conical, cylindrical, or pyramidal. The staging areas 142 are provided with means such as pegs or slots to fixedly hold the disks thereon (not shown). Game pieces can include three reflecting devices: pyramid 130, cylinder 132, and cone 134. The scrambled image I' can be different on each staging area 142 such that only the appropriate anamorphic reflecting device would reveal a message contained on the scrambled image I' to that player having the appropriate device. The devices can be plain reflecting devices or can have partial images imprinted on them to mesh with the decoded, reflected image. Between staging areas 142 can be incremental move steps 146 such that by roll of dice, or by other method the player can move his piece around the game path. The image I' once decoded by the appropriate anamorphic reflecting device 130, 132, 134 can reveal clues to a game, or can give instructions as to moving ahead a number of spaces, or can reveal a character, giving that player certain powers over other characters determine move characteristics, etc.

Alternately, rather than the disks being decoded by a reflecting device, the disks themselves can be deformed or distorted such as by folding into a square pyramid, or other pyramid or shape and viewing the disk from a central perspective such as described in FIGS. 6 and 7.

Although the present invention has been described with reference to a specific embodiment, those of skill in the art will recognize that changes may be made thereto without departing from the scope and spirit of the invention as set forth in the appended claims.

I claim as my invention:

1. A game comprising:

a display of a preselected winning images;

a plurality of perspectively distorted images;

a means for decoding said plurality of distorted images, said means having a reflective surface for decoding said plurality of distorted images and at least one of said distorted images when decoded by said means matching said preselected winning image, and a plurality of said distorted images when decoded by said means not matching said preselected winning image.

2. The game according to claim 1, wherein said means for decoding comprises a reflecting device placed on said plurality of distorted images.

3. The game according to claim 1, further comprising a further display of a further preselected image; and a supply of further distorted images, at least one of said further distorted images when decoded by said means matching said further preselected image, and a plurality of said further distorted images when decoded by said means not matching said further preselected image.

4. The game according to claim 1, wherein said means for decoding comprises a selectable one of a plurality of geometric reflecting devices including a reflecting cylinder and a reflecting cone.

5. A game comprising:

at least one perspectively distorted image;

wherein said at least one distorted image is generated by a computer on a computer screen; and a mathematically computer generated reflecting device displayed on said computer screen for decoding said at least one distorted image, and said one distorted image when decoded reveals game information.

6. A game comprising:

a plurality of perspectively distorted images;

wherein said distorted images are positions on a game board; and a plurality of selectable geometric reflecting devices, said reflecting devices being game pieces each having a reflecting surface, at least one of said selectable reflecting devices decoding at least one of said distorted images to reveal game information.

7. A game comprising:

at least one perspectively distorted image;

a geometric reflecting device having a reflecting surface for decoding said one of distorted image, and said one distorted image when decoded by said reflecting surface reveals game information;

wherein said at least one distorted image is broken into puzzle pieces, said puzzle pieces movable in relative position to create said one distorted image to be decoded by said reflecting surface.

8. A game, comprising:

a display of a preselected image;

a plurality of substrates each having a different visually distorted image thereon;

a reflecting device having a reflecting surface shaped to receive each of said distorted images and to display corresponding reshaped images on said reflecting surface, at least one of said reshaped images matching said preselected image and a plurality of said reshaped images not matching said preselected image.

9. The game according to claim 8, wherein said reflecting device is shaped as a cone.

10. The game according to claim 8, wherein said reflecting device comprises a pyramid having three or more outstanding sides.

11. The game according to claim 8, wherein said reflecting device is shaped as a right circular cylinder.

12. The game according to claim 8, wherein said reflecting device comprises a can for holding a commodity.

13. The game according to claim 12, wherein said can comprises a beverage can wherein portions of said beverage can are rendered reflective to comprise said reflecting surface.

14. The game according to claim 8, wherein said reflecting device is geometrically shaped and placed onto said substrate at a preselected location to decode said distorted game information, said reflecting device having a light source for illuminating said distorted game information onto said reflecting device.

15. The game according to claim 14, wherein said illuminating device comprises an annular lighted surface surrounding said geometric reflecting device.

16. The game according to claim 8, wherein at least one of said plurality of substrates comprises a plurality of substrate pieces which when placed together in a preselected relative orientation forms a respective distorted image thereon received by said reflecting surface, and said reflecting surface displays said corresponding reshaped image which matches said preselected image.

17. The game according to claim 8, wherein said preselected image comprises a displayed alpha-numeric instruction.

18. A game, comprising:

a substrate having a distorted image applied thereon which includes visually distorted game information;

a reflecting device having a reflecting surface shaped to receive said distorted game information to decode said distorted game information and to display corresponding decoded game information on said reflecting surface;

wherein said distorted image is generated by a computer.

19. A game, comprising:

a substrate having a distorted image which includes visually distorted game information applied thereon;

a reflecting device having a reflecting surface shaped to receive said distorted game information to decode said distorted game information and to display corresponding decoded game information on said reflecting surface; and wherein said reflecting device is geometrically shaped having a partial image applied onto said reflecting surface, said reflecting device arranged to be positioned on said substrate with said reflecting surface arranged to correct the distortion of said distorted image and to combine said distorted image with said partial image to render a complete recognizable image on said surface of said reflecting device.

20. The game according to claim 19, wherein one of said reflecting device or said substrate comprises a visual indicator displaying said complete recognizable image separate from said decoded image.

21. The game according to claim 19, wherein said reflecting device comprises a commodity container having said reflecting surface applied thereon.

22. The game according to claim 21, wherein said commodity container is a beverage can.

23. A game, comprising:

a substrate having a distorted image applied thereon which includes visually distorted game information;

a reflecting device having a reflecting surface shaped to receive said distorted game information to decode said distorted game information and to display corresponding decoded game information on said reflecting surface;

wherein said reflecting device comprises a canister having a removable top, and said substrate is sized to be stored within said canister.

24. The game according to claim 23, wherein said canister comprises a circular cross-section cylinder.

25. The game according to claim 23 wherein said canister comprises a cylindrical shape and said substrate is sized to be rolled and stored within said canister.

26. A game, comprising:

a substrate having a distorted image applied thereon which includes visually distorted game information;

a reflecting device having a reflecting surface shaped to receive said distorted game information to decode said distorted game information and to display corresponding decoded game information on said reflecting surface;

wherein said reflecting device comprises a light source casting light upon said substrate.

27. The game according to claim 26 wherein said light source comprises an annular lighted surface surrounding said reflecting device for illuminating said distorted game information onto said reflecting device.

28. A game, comprising:

a substrate having a distorted image applied thereon which includes visually distorted game information;

a reflecting device having a reflecting surface shaped to receive said distorted game information to decode said distorted game information and to display corresponding decoded game information on said reflecting surface;

wherein said substrate has a question applied thereon to which said decoded game information is a confirmation of a correct answer to said question.

29. The game according to claim 28 further comprising a plurality of further substrates each with a different distorted image applied thereon;

and said substrate and said further substrates each comprise a separate sheet; and said reflecting surface shaped to receive each of said different distorted images to decode said distorted images to display decoded images on said reflecting surface;

wherein each of said respective further substrates has a respective different question applied thereon to which said decoded image from said respective substrate is a corresponding confirmation of a correct answer to said respective different question.

30. A game comprising:

a plurality of perspectively distorted images;

a reflecting device having a reflecting surface and placed on the distorted image for decoding at least one of said plurality of distorted images; and said one distorted image when decoded by said reflecting device reveals game information;

wherein said reflecting device has a removable top and said plurality of distorted images are sized to be stored within said reflecting device when not in use.

31. The game according to claim 30, wherein said distorted images are rolled in scroll form and deposited within said reflecting device.

32. A game, comprising:

a substrate having a distorted image applied thereon which includes visually distorted game information;

a reflecting device having a reflecting surface shaped to receive said distorted game information to decode said distorted game information and to display corresponding decoded game information on said reflecting surface;

wherein said reflecting device comprises a package for holding a commodity.

33. The game according to claim 32, wherein said package comprises a beverage holding container.

34. The game according to claim 33, wherein said beverage holding container comprises a cylinder.

35. The game according to claim 34, wherein said reflecting surface includes a partial image applied thereon, said partial image arranged to combine with said decoded game information reflected on said reflecting surface to display a resulting completed image.

36. The game according to claim 34, wherein said cylinder includes an opening on a top side thereof for dispensing a beverage from said cylinder.

37. The game according to claim 32, wherein said reflecting surface includes a partial image applied thereon, said partial image arranged to combine with said decoded game information reflected on said reflecting surface to display a resulting completed image.

38. The game according to claim 32 wherein said package comprises a can.

39. The game according to claim 38 wherein said can comprises a beverage can wherein portions of said beverage can are rendered reflective to comprise said reflecting surface.

40. The game according to claim 32, further comprising a supply of a commodity held within said package and wherein said commodity is a food product.

41. The game according to claim 32 wherein said reflecting device comprises a cylindrical beverage holding container carrying said reflecting surface on an outside thereof and further comprising a beverage at least partially filling said container to be dispensed therefrom.

42. The game according to claim 32 wherein said distorted image is distorted as a cylindrical anamorphic distortion, and said reflecting surface is a cylinder having a diameter, said cylindrical anamorphic distortion is geometrically distorted according to the diameter to be accurately decoded by said cylinder to render an undistorted reflected image on said reflecting surface, when said cylinder is placed onto said substrate.

43. The game according to claim 42 wherein said cylinder is a hand held beverage container.

44. The game according to claim 43 wherein said reflecting surface is a mirrored surface.

45. A game, comprising:

a package including a substrate having a distorted image which includes visually distorted game information applied thereon;

a reflecting device having a reflecting surface shaped to receive said distorted game information to decode said distorted game information and to display corresponding decoded game information on said reflecting surface; and wherein said substrate comprises a wall portion of said package.

46. The game according to claim 45, wherein said reflecting device is stored in said package and further comprising a commodity stored in said package with said reflecting device.

47. The game according to claim 46, wherein said package comprises a box and said commodity is a food product.

48. A game, comprising:

a substrate having a distorted image which includes visually distorted game information applied thereon;

a reflecting device having a reflecting surface shaped to receive said distorted game information to decode said distorted game information and to display corresponding decoded game information on said reflecting surface; and a removable layer overlying said substrate, wherein at least a portion of said distorted game information is covered by said removable layer overlying said substrate.

49. The game according to claim 48 wherein said removable layer comprises a scratch-off emulsion applied onto said distorted game information.

50. A game, comprising:

a plurality of substrates each having a distorted image applied thereon which includes visually distorted game information;

a plurality of reflecting devices each having a reflecting surface shaped to receive said distorted game information from each of said substrates to decode said distorted game information and to display corresponding decoded game information on said reflecting surface; and wherein said game is a contest and said decoded-game information of a preselected winning combination of a particular substrate selected from said substrates, and a particular reflecting device selected from said reflecting devices is a visual confirmation of the winning combination.

51. The game according to claim 50, wherein said particular reflecting device has applied on a reflecting surface thereof a partial image which combines with said decoded game information of said particular substrate to form said game instruction.

52. A game, comprising:

a substrate having a distorted image which includes visually distorted game information applied thereon;

a reflecting device having a reflecting surface shared to receive said distorted game information to decode said distorted game information and to display corresponding decoded game information on said reflecting surface, said decoded game information comprising a game instruction; and a plurality of further reflecting devices, each reflecting device having a reflecting surface with a partial image applied thereon, and when each reflecting device is placed on said substrate, each reflecting device combines with said decoded game information to form a further game instruction.

53. The game according to claim 52 wherein said reflecting device and said further reflecting devices comprise cylindrical beverage containers.

54. A method of playing a game comprising the steps of:

providing a preselected image;

providing a plurality of substrates each substrate formed of at least one piece, each substrate having a different visually distorted image thereon;

providing a reflecting device having a reflecting surface shaped to receive each of said distorted images and to display corresponding optically reshaped images on said reflecting surface, at least one of said reshaped images matching said preselected image, and a plurality of said reshaped images not matching said preselected image; and by random selection, selecting one of said plurality of substrates, and using the reflecting device, optically reshaping the distorted image on said reflecting surface and comparing the respective reshaped image to said preselected image.

55. The method according to claim 54, wherein said step of providing a reflecting device is further defined in that said reflective device includes a partial image applied thereon; and said step of optically reshaping the distorted image using said reflecting device includes the steps of reflecting the distorted image onto said reflecting surface to create a reflection and combining the reflection with the partial image.

56. A method of playing a game, comprising the steps of:

providing a preselected image;

providing at least one substrate, each substrate formed of at least one piece, each substrate having a visually distorted image thereon;

providing a plurality of different reflecting surfaces to receive said distorted image and to display corresponding optically reshaped images on each reflecting surface, at least one of said reshaped images matching said preselected image, and a plurality of said reshaped images not matching said preselected image; and by random selection, selecting one of said plurality of reflecting surfaces, optically reshaping the distorted image on said one reflecting surface, and comparing the respective reshaped image to said preselected image.

57. The method according to claim 56, wherein said reflecting surfaces have substantially similar shapes but each has a different partial image applied thereon, and said step of optically reshaping the distorted image using said one reflecting surface includes the steps of reflecting the distorted image onto said one reflecting surface and creating a reflection, and combining the reflection with the partial image applied on said one reflecting surface.

58. A game comprising:

a display of a preselected image;

a substrate having a visually distorted image thereon;

a plurality of reflecting devices each having a reflecting surface portion shaped to receive at least a portion of said distorted image and to display a corresponding reshaped image on said reflecting surface portion, at least one of said corresponding reshaped images matching said preselected image and a plurality of said corresponding reshaped images not matching said preselected image.

59. The game according to claim 58, wherein said plurality of reflecting devices are shaped as cylinders.

60. The game according to claim 58, wherein said plurality of reflecting devices each comprise a food-commodity-holding container having the reflecting surface portion applied thereon.

61. The game according to claim 58, wherein each of said reflecting surface portions include a partial image applied thereon which combines with a reflection of said distorted image to form said corresponding reshaped image.

* * * * *